US009168735B2

(12) United States Patent
Webb et al.

(10) Patent No.: US 9,168,735 B2
(45) Date of Patent: Oct. 27, 2015

(54) INKJET RECORDING MATERIAL

(75) Inventors: Steven L. Webb, Murrieta, CA (US); Christopher Arend Toles, Escondido, CA (US)

(73) Assignee: Hewlett-Packard Development Company L.P., Houston, TX (US)

( * ) Notice: Subject to any disclaimer, the term of this patent is extended or adjusted under 35 U.S.C. 154(b) by 0 days.

(21) Appl. No.: 14/355,200

(22) PCT Filed: Nov. 18, 2011

(86) PCT No.: PCT/US2011/061389

§ 371 (c)(1), (2), (4) Date: Apr. 29, 2014

(87) PCT Pub. No.: WO2013/074117

PCT Pub. Date: May 23, 2013

(65) Prior Publication Data

US 2014/0307025 A1 Oct. 16, 2014

(51) Int. Cl.
*B41M 5/52* (2006.01)
*B41J 2/01* (2006.01)

(52) U.S. Cl.
CPC ... *B41J 2/01* (2013.01); *B41M 5/52* (2013.01); *B41M 5/5218* (2013.01); *B41M 5/5254* (2013.01); *B41M 2205/34* (2013.01)

(58) Field of Classification Search
CPC ..... Y10T 428/24802; B41M 5/52
See application file for complete search history.

(56) References Cited

U.S. PATENT DOCUMENTS

| | | | | |
|---|---|---|---|---|
| 4,944,988 | A | 7/1990 | Yasuda et al. | |
| 5,714,270 | A | 2/1998 | Malhotra et al. | |
| 6,531,537 | B2 | 3/2003 | Friel et al. | |
| 6,841,206 | B2 | 1/2005 | Quintens et al. | |
| 7,074,842 | B2 | 7/2006 | Chung et al. | |
| 7,297,382 | B2 | 11/2007 | Van Aert et al. | |
| 2002/0094421 | A1 * | 7/2002 | Quintens et al. | 428/195 |
| 2002/0136869 | A1 * | 9/2002 | Matsumura et al. | 428/195 |
| 2003/0112311 | A1 | 6/2003 | Naik et al. | |
| 2004/0234709 | A1 * | 11/2004 | Ishida et al. | 428/32.34 |
| 2005/0287311 | A1 | 12/2005 | Chen et al. | |
| 2006/0204685 | A1 * | 9/2006 | Missell et al. | 428/32.34 |
| 2007/0128460 | A1 | 6/2007 | Miller | |
| 2007/0235119 | A1 | 10/2007 | McManus et al. | |
| 2007/0237909 | A1 * | 10/2007 | McManus | 428/32.34 |
| 2008/0107817 | A1 | 5/2008 | Fitzgerald et al. | |

FOREIGN PATENT DOCUMENTS

| | | | |
|---|---|---|---|
| CN | 1544252 | | 11/2004 |
| EP | 2060404 | A1 | 5/2009 |
| EP | 1419893 | A1 | 7/2015 |
| WO | WO-0032407 | A1 | 6/2000 |
| WO | WO-2006011948 | A1 | 2/2006 |

* cited by examiner

*Primary Examiner* — Gerard Higgins
*Assistant Examiner* — Sathavaram I Reddy
(74) *Attorney, Agent, or Firm* — Dierker & Associates, P.C.

(57) ABSTRACT

An inkjet recording material that contains a supporting substrate and an image-receiving layer formed on at least one side of the supporting substrate, said layer including at least one inorganic pigment, and a latex binder having the formula (I). Also disclosed herein are the method of making said inkjet recording material and a method for producing printed images that encompasses using said recording material.

16 Claims, 1 Drawing Sheet

INKJET RECORDING MATERIAL

BACKGROUND

Inkjet technology has expanded its application to high-speed, commercial and industrial printing, in addition to home and office usage. In this printing method, print media play a key role in the overall image quality and permanence of the printed images. Thus, it has often created challenges to find media that can be effectively used with such printing techniques. Coated recording materials (or media) are available for inkjet technology to produce high image quality comparable to that of offset printing. It is desirable to make these recording material low cost to enable inkjet printing to be cost-efficient and to compete with traditional analog printing or other digital printing technologies, like laser printing or liquid electrophotography technologies.

In view of obtaining a superior image quality, coated recording materials have been developed for inkjet technology process, especially, for high-speed printers. Such materials have single or multiple image-receiving layers that are disposed onto a media substrate, i.e. layer onto which ink droplets are deposited.

The image-receiving layer is often made of a coating composition that includes inorganic or organic pigments as the filler and polymeric materials as the binder, along with other optional functional materials. The image-receiving layer often promotes performance of the ink receiving properties of the media such as image quality and durability. It also improves the sheet quality of the printing media. For example, coated media show superior physical properties over uncoated media in terms of paper physical appearance such as gloss and surface smoothness.

Though the above list of characteristics provides a worthy goal to achieve, there are difficulties associated with satisfying all of the above characteristics. Accordingly, investigations continue into developing coating formulations that provides high quality recording materials.

BRIEF DESCRIPTION OF THE DRAWING

The drawings illustrate various embodiments of the present article and are part of the specification.

DETAILED DESCRIPTION

Figure 1:
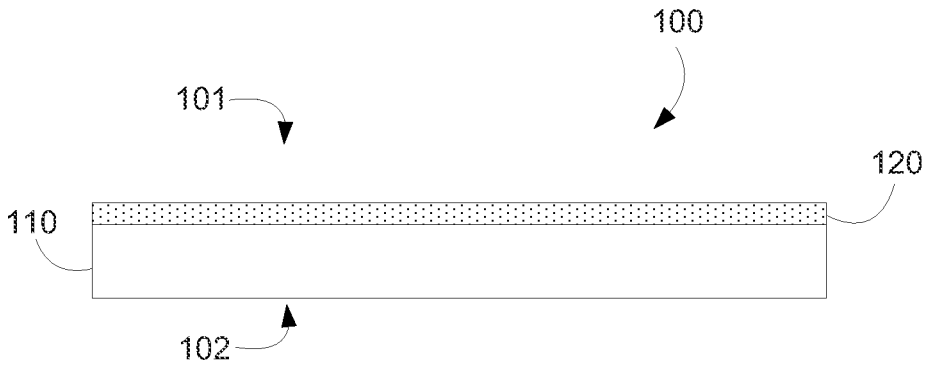
FIG. 1 and FIG. 2 are cross-sectional views of an inkjet recording material according to some embodiments of the present disclosure.

Before particular embodiments of the present disclosure are disclosed and described, it is to be understood that the present disclosure is not limited to the particular process and materials disclosed herein. It is also to be understood that the terminology used herein is used for describing particular embodiments only and is not intended to be limiting, as the scope of protection will be defined by the claims and equivalents thereof. In describing and claiming the present article and method, the following terminology will be used: the singular forms "a", "an", and "the" include plural referents unless the context clearly dictates otherwise. Thus, for example, reference to "a pigment" includes reference to one or more of such materials. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. All percents are by weight (wt %) unless otherwise indicated. As another example, a range of 1 part to 20 parts should be interpreted to include not only the explicitly recited concentration limits of about 1 part to about 20 parts, but also to include individual concentrations such as 2 parts, 3 parts, 4 parts, etc. All parts are dry parts in unit weight, with the sum of the inorganic pigment equal to 100 parts, unless otherwise indicated.

The present disclosure refers to an inkjet recording material that contains a supporting substrate and an image-receiving layer, formed on at least one side of the supporting substrate, said layer containing at least one inorganic pigment and a latex polymer binder having monomers of the general formula (I)

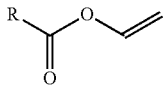

wherein R is a branched, cyclic or unbranched alkyl group containing from 1 to 20 carbon atoms. Also disclosed herein is a method for making said inkjet recording material as well as a method for producing printed images using such inkjet recording material.

The image-receiving layer, that is part of the inkjet recording material of the present disclosure, is formed using a coating composition, also called image-receiving layer composition. Said coating composition is a mixture of different ingredients that encompasses, at least, one inorganic pigment, and a latex polymer binder having monomers of the general formula (I).

The coating or image-receiving layer composition, when used to form an image-receiving layer on an inkjet recording material, improves the printing performances said recording material. For examples, it increases the back optical density and color gamut of the image that is printing on said recording material. Furthermore, the coating composition, when used to form an image-receiving layer on a recording material or media substrate, increases the durability of the printed image. In addition, the image-receiving layer when present on the recording material, improves the overall print quality and the physical qualities of the said recording material, including bleeding performances and durability of the ink.

Without being bound by the theory, it is believed that the recording material that contains a supporting substrate and an image-receiving layer, formed on at least one side of the supporting substrate, containing at least one inorganic pigment and a latex polymer binder having monomers of the general formula (I), when used in inkjet printing, imparts good image quality, including improved durability performances and highlighter smear resistance. The term "highlighter smear resistance" refers herein to the resistance of a printed image to smearing/blurring when stroked with a highlighter marker.

The inkjet recording material, according to the present disclosure, encompasses thus an supporting substrate and an image-receiving layer. The image-receiving layer or ink-receiving layer is a coating layer formed by applying a coating composition directly onto a supporting substrate. The supporting substrate can be an uncoated paper base or a pre-coated paper base (i.e., a paper base coated with one or more intermediate coatings).

Figure 2:
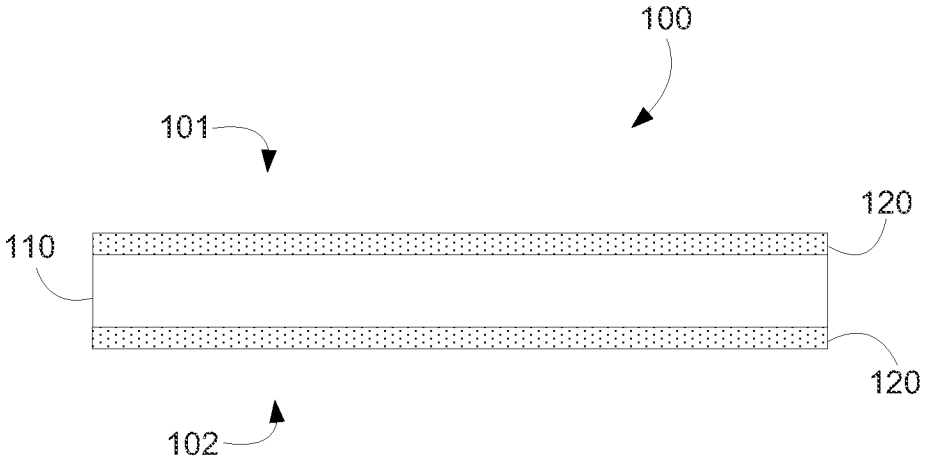

FIG. 1 and FIG. 2 illustrate some embodiments of the inkjet recording material (100) of the present disclosure. As will be appreciated by those skilled in the art, FIG. 1 and FIG. 2 illustrate the relative positioning of the various layers of the recording media (100) without necessarily illustrating the relative thicknesses of said layers. As shown in FIG. 1 and FIG. 2, the recording material (100) encompasses a base supporting substrate (110). The supporting substrate (110) has two surfaces: a first surface that might be referred to as the "image surface" or "image side" (101), and a second surface, the opposite surface, which might be referred to as the "back surface" or "back side" (102). FIG. 1 illustrates some embodiments of the recording material (100) wherein such material includes an image-receiving layer (120) that is applied on the image side (101) of the supporting substrate (110). FIG. 2 illustrates some other embodiments of the recording material (100) wherein such material includes image-receiving layers (120) that are formed on both sides of the supporting substrate (110). The image-receiving layers (120) are thus present on the backside (102) and on the image side (101) of the base substrate (110).

The image-receiving layer (120) of the recording material (100) can have a gloss level above about 25 as measured at a 75-degree view angle. In some examples, the image-receiving layer has a gloss level of about 50 to about 75 as measured at a 75-degree view angle using a Micro-gloss 5-degree gloss meter manufactured by BYK-Gardner GmbH (Geretsried, Del.).

The image-receiving layer (120) can have a thickness greater than about 1 micron (μm). In some examples, the image-receiving layer (120) has a thickness of about 2 microns (μm) to about 50 microns (μm). As illustrated in FIG. 1 and in FIG. 2, the image-receiving layer (120) is the outermost layer of media sheet (100); the image-receiving layer receives then marking fluid, e.g., liquid ink droplets, ejected from an imaging device during a printing process.

In some examples, the inkjet recording material encompasses an image-receiving layer that has a coat weight that is in the range of about 0.5 to about 20 gram per square meter ($g/m^2$), or, in some other examples, in the range of about 1 to about 10 gram per square meter ($g/m^2$).

Latex Polymer Binder

In some embodiments, the inkjet recording material (100) encompasses an image-receiving layer (120) that contains a latex polymer binder. Latex polymer binders include both latex particulates as well as the aqueous medium in which the latex particulates are dispersed. More specifically, the latex polymer binder is a liquid suspension containing a liquid (such as water and/or other liquids) and polymeric particulates with size ranging from about 20 nm to about 500 nm in diameters. In some examples, the latex polymer binder is an aqueous emulsion in the form of latex particles wherein the latex particle size ranges from about 150 to about 350 nanometers. In some embodiments, the latex polymer binders are polymers having monomers of the general formula (I)

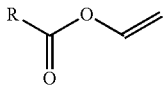

wherein R is a branched, cyclic or unbranched alkyl group containing from 1 to 20 carbon atoms. In some examples, R is a branched, cyclic or unbranched alkyl groups containing from 1 to 9 carbon atoms. In some other examples, R is a branched, cyclic or unbranched alkyl groups containing 1, 2 or 9 carbon atoms. In yet some other examples, $R_1$ is $CH_3$, $CHCH_3$ or $CH_3(CH_2)_5C(CH_3)_2$. The term "alkyl" as used herein means a branched, cyclic or unbranched saturated hydrocarbon group, which can contains from 1 to about 20 carbon atoms, or 1 to about 10 carbon atoms for example. Alkyls include, but are not limited to, methyl, ethyl, n-propyl, isopropyl, n-butyl, isobutyl, t-butyl, octyl, and decyl, for example, as well as cycloalkyl groups such as cyclopentyl, adamantyl and cyclohexyl, for example. R can be a substituted alkyl group or a heteroalkyl alkyl group. As used herein, the term "substituted alkyl" means an alkyl substituted with one or more substituent groups. The term "heteroalkyl" means an alkyl in which at least one carbon atom is replaced with a heteroatom.

In some embodiments, the latex polymer binders are terpolymers having, as monomers, compounds of the formula:

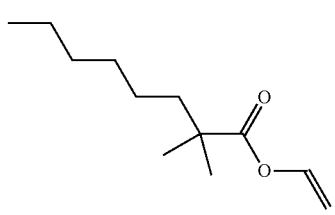

(II)

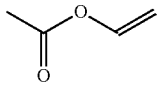

(III)

and/or

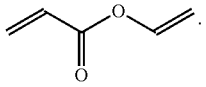

(IV)

In some other embodiments, the latex polymer binders are polyethylene-vinylversatate copolymers. In yet some other embodiments, the latex polymer binders are terpolymers containing monomers selected from the group consisting of vinyl acetate monomer, vinyl acrylate monomer and vinyl versatate monomer.

Latex polymer binders can be commercially available under the tradename Neocar® 2300 from Arkema Emulsion systems. Such latex polymer binders are present, in the image-receiving layer formulation, in an amount representing from about 0.1 wt % to about 30 wt % or in an amount representing from about 1 wt % to about 15 wt % based on the total weight of the image-receiving layer formulation.

Inorganic Pigment

The image-receiving layer (120) of the inkjet recording material (100), as described herein, contains, at least, an inorganic pigment. The inorganic pigment (or inorganic particle) may be calcium carbonate, modified calcium carbonate, zeolite, silica, talc, alumina, boehmite, pseudoboehmite, silicates (such as aluminum silicate, calcium silicate, magnesium silicate and the like), aluminum trihydrate (ATH), titania, zirconia, clays (kaolin, calcined clay) or any combinations thereof. In some examples, the inorganic pigment is selected from the group consisting of silica, boehmite, pseudoboehmite, calcium carbonate, precipitated calcium carbonate (PCC), ground calcium carbonate (GCC), modified calcium carbonate (MCC) and kaolin clay. The physical form of the pigment can be either powder or aqueous predispersed slurry. In some other examples, the inorganic pigment is calcium carbonate (PCC, GCC, MCC), kaolin clay or a combination thereof.

Co-pigments can be present in the image-receiving layer (120). Such co-pigments include, for example, pigments that have both a micro-porous structure, such as fumed silica and silica gel, modified calcium carbonate and "structured" pigments. Examples of structured pigments are calcined clays and porous clay/calcium carbonate that are reaction products of clay/calcium carbonate with colloidal silica. Other inorganic particles such as particles of titanium dioxide ($TiO_2$), silicon dioxide ($SiO_2$), aluminum trihydroxide (ATH), calcium carbonate ($CaCO_3$) and zirconium oxide ($ZrO_2$) can be inter-calcined into the structured clay or calcium carbonate. Co-pigment particles may be substantially non-porous mineral particles that have a special morphology that can produce a porous coating structure when solidified into a image-receiving layer.

The amount of inorganic pigments present in the image-receiving layer (120) may be from about 40 to about 95% by weight (wt %) or may be from about 60 to about 90% by weight (wt %) based on the total weight of the coating layer (120).

In some embodiments, the image-receiving layer includes a first inorganic pigment and a second inorganic pigment. The first inorganic pigment can have an average particle size of less than about 1 micron (μm) or less than about 0.4 micron (μm). The second pigment can have an average particle size in the range of about 0.5 to about 10 μm, or in the range of about 0.5 to about 5 μm, or in the range of about 0.8 to about 2 μm. The first pigment, in the coating composition, can be precipitated calcium carbonate (PCC) particles. The precipitated calcium carbonates (PCC) often have a narrow size-distribution. Since a smaller size particle gives high liquid absorption rate, a narrow size-distribution of PCC particles with small particle size might be desirable in the image-receiving layer. Suitable preparations of PCC particles are commercially available from Specialty Minerals Inc under the name Opacarb® A40 (aragonitic crystalline structure). Alternatively, PCC particles in the specified size ranges may be prepared in accordance with methods, that are described in the literature (For example, Chapter 2, in "The Coating Processes" edited by J. C. Walter, Tappi Press, Atlanta, Ga., 1993). The first pigment can also be ultrafine kaolin clay, such as Miraglos® 91, manufactured by Englehard Corporation (Iselin, N.J., U.S.A.), or Polygloss® 90, manufactured by J.M. Huber Corporation (Edison, N.J., U.S.A.). The first pigment may act to provide a gloss characteristic of image-receiving layer (120) and to improve the uniformity of the ink absorption. In some examples, the first inorganic pigment is precipitated calcium carbonate (PCC). In some other examples, the first inorganic pigment is precipitated calcium carbonate (PCC) and is present in an amount ranging from about 20 wt % to about 60 wt % based on the total dry weight of inorganic pigments.

The first inorganic pigment can be present, in the image-receiving layer, in an amount ranging from about 1 wt % to about 80 wt % based on the total dry weight of pigments; or is present in an amount ranging from about 25 wt % to about 60 wt %.

The second inorganic pigment can have a larger particle size that the first pigment and can generate many pores of greater size than with the first pigment alone. Without being limited to any theory, it is believed that inclusion of the second pigment disrupts the packing structure of the first pigment, creating voids between particles that enhance the flow and storage of liquid. The second pigment can be ground calcium carbonate (GCC pigment), or clay pigment such as kaolin clay, hydrated clay, calcined clay, or other material that is capable of functioning in a similar manner. In some examples, the second pigment is ground calcium carbonate (GCC pigment), or clay pigment. In some other examples, the second pigment is MCC (modified calcium carbonate) such as the one marketed by Omya under the tradename Omyajet® 5020.

Ground calcium carbonate (GCC), modified calcium carbonate (MCC) and clay particles may be prepared in accordance with methods that are described, for example, in Chapter 2, in "The Coating Processes" edited by J. C. Walter, Tappi Press, Atlanta, Ga., 1993. In some examples, the second pigment can be calcined clay, such as Ansilex® 93, manufactured by Englehard Corporation (Iselin, N.J., U.S.A.), or Neogen® 2000, manufactured by Imerys Pigments, Inc. (Roswell, Ga., U.S.A.). Without being linked by any theory, it is believed that the second pigment may act to provide a good absorption to the recording material so that ink ejected onto the recording material (120) is sufficiently dry after an imaging device has finished disposing images on the media.

In some examples, the amount of the second inorganic pigment present in the image-receiving layer (120), is ranging from about 20 wt % to about 90 wt %, or ranging from about 40 wt % to about 80 wt % based on the total dry weight of inorganic pigments.

The image-receiving layer composition may further include a third pigment. Said third pigment could be added in order to further improve liquid penetration in the coated recording material, especially when said recording material is intended for use in an inkjet digital printing application. The third pigment can have a higher surface area than the first and second pigments, in some examples, 50 $m^2$ per gram, 100 $m^2$ per gram or 200 $m^2$ per gram. Suitable materials for the third pigment particles include, but are not limited to, fumed silica, silica gel, colloidal silica, zeolite, and alumina; although any other suitable material capable of functioning similarly to those materials could be used. In some examples, the third pigment is silica. The silica pigment particle may have either a porous secondary structure of primary particles with small particle size, or many internal porous structures in each particle. Suitable silica include, but are not limited to, fumed silica, silica gel, colloidal silica, and precipitated silica. When present in the image-receiving layer composition, said third pigment could be present in an amount representing from about 1 to about 80 wt %, or in an amount from about 10 to about 60 wt %, based on the total dry weight of inorganic pigments.

In some embodiment, the inkjet recording material encompasses an image-receiving layer formed on at least one side of a supporting substrate, said layer containing at least three pigments, wherein the first pigment is precipitated calcium carbonate (PCC), wherein the second pigment is ground calcium carbonate (GCC) or clays, and wherein the third pigment is a silica pigment or a combination of different silica pigments.

Optional Ingredients

The image-receiving layer (120) may further include optional additives such as biocides, surfactants, plasticizers, rheology modifiers, defoamers, optical brighteners, dyes, pH controlling agents, and other additives for further enhancing the properties of the coating. The total amount of optional coating additives may be in the range of about 0 to about 5 wt % based on the total dry weight of organic pigment.

Among these additives, rheology modifiers are useful for addressing runnability issues. Suitable rheology modifiers include polycarboxylate-based compounds, polycarboxylated-based alkaline swellable emulsions, or their derivatives. Rheology modifiers are helpful for building up the viscosity at certain pH, either at low shear or under high shear, or both. Examples of rheology modifiers include, but are not limited to, Sterocoll® FS (from BASF), Cartocoat® RM 12 (from Clariant), Acrysol® TT-615 (from Rohm and Haas) and Acumer® 9300 (from Rohm and Haas).

The image-receiving layer (120) can include surfactants. There is no specific limitation on the chemical structure of surfactant used in the image-receiving layer. In some examples, polyalkylene oxide based surfactant such as Surfynol® (supplied by Air Product), or the silicone base surfactants (BYK® surfactants supplied by BYK Inc) can be used in said coating layer.

The image-receiving layer (120) may also include, as an optional component, a polymeric co-pigment. Suitable polymeric co-pigments include plastic pigments (e.g., polystyrene, polymethacrylates, polyacrylates, copolymers thereof, and/or combinations thereof). Suitable solid spherical plastic pigments are commercially available from The Dow Chemical Company (e.g., DPP 756A or HS 3020). The amount of polymeric co-pigment in the coating composition may be in the range of 1 part to 10 parts based on 100 parts of inorganic pigment. The image-receiving layer (120) may also include water-based binders. Water-based binders include polymer solutions, polymer dispersions and polymer lattices. Suitable binder polymers include polyvinyl alcohol, styrene-butadiene, acrylonitrile-butadiene, styrene-butyl acrylate, acrylic, vinyl acetate, vinylidene chloride, polyester, polyvinylpyrrolidone, copolymers or combinations thereof. In some examples, the image-receiving layer includes polyvinyl alcohol.

The image-receiving layer (120) may also contain ink fixing agents including, but not limited to, divalent or multivalent metallic salts (e.g., a chloride, a bromide, a nitrate or an acetate of calcium, magnesium or aluminum or a combination of any of these). In some examples, the image-receiving layer includes ink fixing agents such as calcium chloride ($CaCl_2$) or Magnesium sulfate ($MgSO_4$).

Supporting Substrate

In some embodiments, the recording material (100) encompasses a supporting substrate (110) having one or two image-receiving layer (120). The supporting substrate (110), on which the coating composition is applied, may take the form of a media sheet or a continuous web suitable for use in an inkjet printer. The supporting substrate may be a base paper manufactured from cellulose fibers. The base paper may be produced from chemical pulp, mechanical pulp, thermal mechanical pulp and/or the combination of chemical and mechanical pulp. The base paper may also include conventional additives such as internal sizing agents and fillers. The internal agents are added to the pulp before it is converted into a paper web or substrate. They may be chosen from conventional internal sizing agents for printing papers. The fillers may be any particular types used in paper making. As a non-limiting example, the fillers may be selected from calcium carbonate, talc, clay, kaolin, titanium dioxide and combinations thereof. The paper base may contain fillers in an amount of about 5% to about 30% by total weight of the raw base. Other applicable substrates include cloth, nonwoven fabric, felt, and synthetic (non-cellulosic) papers. The supporting substrate may be an uncoated raw paper or a precoated paper. In some examples, the supporting substrate (110) is a paper base containing cellulose fibers. The supporting substrate (base sheet) can also have, disposed on it, a plurality of "basecoats" upon which the image-receiving layer, described herein, is applied.

The supporting substrate (110) can have a base weight of about 50 to about 300 grams/meter$^2$ (gsm), or can have a base weight of about 100 to about 220 gsm. In some examples, the opacity of the paper is 70% or more. The opacity of the paper can also be greater than 80%. The TAPPI brightness of the paper can be 70 or more (as measured using TAPPI test method). In some other examples, the brightness of the paper is greater than 80.

The image-receiving layer, described above, can be applied to one side or to both opposing sides of the supporting substrate. If the coated side is used as an image-receiving side, the other side, i.e. backside, may not have any coating at all, or may be coated with other chemicals (e.g. sizing agents) or coatings to meet certain needs such as to balance the curl of the final product or to improve sheet feeding in printer. The double-side coated medium has a sandwich structure, i.e., both sides of the supporting substrate are coated with the same coating and both sides may be printed with images or text.

Coating Method

A method of making a recording material encompasses providing a supporting substrate; applying an image-receiving layer on, at least, one side of the supporting substrate said image-receiving layer containing at least one inorganic pigment and a latex polymer binder having monomers of the general formula (I)

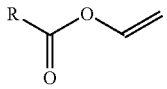

wherein R is a branched, cyclic or unbranched alkyl group containing from 1 to 20 carbon atoms; and, then, drying and calendaring the image-receiving layer. In some examples, the method encompasses applying image-receiving layers on both side of the supporting substrate (110) and drying and calendaring the image-receiving layers (120).

The image-receiving layer composition, i.e. coating composition that forms the image-receiving or ink-receiving layer, may be applied to the supporting substrate (110) using any one of a variety of suitable coating methods, such as blade coating, jet blade coating, air knife coating, size press, slot die, metering rod coating, curtain coating, or another suitable technique. The coating composition can also be applied onto the supporting substrate using low-cost coating method, such as blade coating, jet blade coating, or metering rod coating, and run the coating process at high speed. For a double-side coated material, depending on the set-up of production machine in a mill, both sides of the substrate may be coated during a single manufacture pass, or alternatively, each side may be coated in separate passes. The coating composition can be applied onto a media substrate (e.g., paper) at high application speeds and has a good runnability as defined by the ability to apply the coating composition onto the media substrate and to obtain a defect-free coated medium with a desired coat weight.

The coating composition applied for forming the image-receiving layer can be applied to the paper substrate off-line or in-line of a paper-making machine. The image-receiving coating composition can be applied, for example, to the supporting substrate (such as paper substrate) by a size press on-line during the surface sizing stage while the paper is being manufactured on a paper machine. After the coating, the recording material can be subjected to a drying process to remove water and other volatile components in the image-receiving layer and in the substrate. The drying means includes, but are not limited to, infrared (IR) dryers, hot surface rolls, and hot air floatation dryers. After coating, the recording material may be calendered to increase glossiness and/or to impart a satin surface. When a calendering step is incorporated, the coated medium may be calendered by an on-line or an off-line calender machine, which may be a soft-nip calender or a super-calender. The rolls in the calender machine may or may not be heated, and pressure can be applied to the calendering rolls.

The image-receiving layer may be formed on one or on both sides of the supporting substrate and may have a coating weight of about 0.5 to about 20 grams per square meter ($g/m^2$) per side or a coating weight ranging from about 1 to about 10 $g/m^2$ per side.

Printing Method

A printing method for producing printed images encompasses obtaining an inkjet recording material containing a supporting substrate having an image-receiving layer, formed on at least one side of said supporting substrate, that contains at least one inorganic pigment and a latex polymer binder having monomers of the general formula (I)

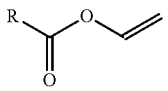

wherein R is a branched, cyclic or unbranched alkyl group containing from 1 to 20 carbon atoms; and jetting an ink composition onto said recording media to form a printed image. The printed image can then be dried.

The inkjet recording material, described herein, is a printing media having a good capacity for receiving and retaining the ink. Such recording material, when used in a printing method, provides therefore good image quality and excellent adherence properties to the ink deposed thereon, as well as improved durability.

In some examples, the method for producing printed images, such as defined herein, is done in a heated environment. The method encompasses projecting a stream of droplets of an ink composition onto said recording material to form the desired printed image: The ink composition may be established on the media via any suitable inkjet printing technique. Non-limitative examples of such inkjet printing techniques include thermal, acoustic, continuous and piezoelectric inkjet printing. The inkjet recording media can be used with any suitable inkjet printer and with any ink composition used for inkjet printing. Examples of such printers are HP L25500 and HP L65500 (Hewlett-Packard Corporation). By inkjet composition, it is meant herein that the composition is very well adapted to be used in an inkjet printing device and/or in an inkjet printing process.

The preceding description has been presented to illustrate and describe some embodiments of the disclosure. However, it is to be understood that the following examples are only illustrative of the application of the principles of the present material and methods.

EXAMPLES

Ingredients

TABLE 1

| Ingredient names | Nature and suppliers |
|---|---|
| Opacarb ® A40 | Precipitated calcium carbonate (PCC) available from Specialty Minerals Inc. |
| OmyaJet ® 5020 | Modified calcium carbonate available from Omya. |

TABLE 1-continued

| Ingredient names | Nature and suppliers |
|---|---|
| Styronal ® D628 | Latex binder (Styrene-Butadiene Acrylonitrile) available from BASF Corp. |
| STR ® 5401 | Latex binder (Styrene Butadiene) available from Dow Chemical. |
| Gencryl ® PT9525 | Latex binder (Styrene-Butadiene Acrylonitrile) available from Omnova. |
| Neocar ® latex 2300 | Latex binder (Vinyl Versatate-based Terpolymer) available from Arkema. |
| Styron ® XZ | Latex binder, available from Styron LCC. |
| Acronal ® s728 | latex binder (styrene acrylic) available from BASF Corp. |
| Mowiol ®15-99 | Polyvinyl alcohol binder available from Clariant. |
| Agitan ®103 | Defoamer available from Munzing. |
| Wax- Ultra lube E846 | Available from Keim Additec. |
| Carteren ®Violet 79732 | Dye available from Clariant Corp. |
| Tinopal ® | Optical brightener available from Ciba Specialty Chemicals. |
| Ansilex ®93 | Calcined clay available from BASF Corp. |
| Sylojet ®a25 | Pigment available from Grace Davison. |
| Mowiol ®15-79 | Binder available from Clariant. |
| Gasil ®IJ624 | Pigment available from Ineos Silicas. |
| Rheovis ®802 | Rheology Modifiers available from Clariant CIBA. |

Example 1

Latex Binder Affinity for Ink

Several formulations are made up using a mixture of Opacarb® A40 (Precipitated calcium carbonate) and 14 wt % of different latex binders (based on total weight of PCC solids) as illustrated in TABLE 2. The formulations are poured into shallow aluminum pans and dried gently in a forced draft oven. 24 hours later, 20 μL droplets of pigment WebPress ink composition (Senjed ink) are applied to these "cakes" and let sit for 1 minute. Thereafter, 5 ml of deionized water is used to rinse off the ink droplets. The left over ink on the cake is what is held by the formulation containing PCC and latex binder. A high amount of left over demonstrates a high affinity between the ink and the latex binder (the darkest the stain is after rinsing, the higher the affinity is). In view of quantifying this effect, photographs of the stains, after rinsing, are taken. The images are processed in Photoshop and converted to 8 bit grayscale (0-255). A section of the stain is analyzed using the "histogram" tool (giving the value of the stain 0-255), in order to take into account the poor lighting of the image, a selection is made of unstained "cake", and its pixel value is measured. The two values are subtracted (black value—white value, i.e. called "Delta") and plotted for 3 replicates of the 5 lattices examined. The results are shown in TABLE 2 below. The higher the "Delta" value is, the darker is the stain. The results demonstrate that the combination containing PCC and Neocar® 2300 latex formulation has the darkest ink stain, indicating, thus, the strongest affinity for the ink. When using such combination, the ink is tightly held, resulting in the "darkest" stain after rinsing. All other lattices retain less ink and show much less ink staining.

TABLE 2

| Latex Binder | Delta measurements | Average delta (based on the 3 measurements) |
|---|---|---|
| Neocar ® latex 2300 | 101, 102 108 | 104 |
| Gencryl ® PT9525 | 33, 34, 35 | 34 |
| STR ® 5401 | 29, 32, 36 | 33 |

TABLE 2-continued

| Latex Binder | Delta measurements | Average delta (based on the 3 measurements) |
|---|---|---|
| Styron ® XZ | 27, 27, 29 | 28 |
| Styronal ® D628 | 38, 36, 35 | 36 |

Example 2

Coating Compositions and Inkjet Recording Material

Coating compositions (a), (b), (c) and (d), are made with precipitated calcium carbonate (Opacarb® A40) and modified calcium carbonate (OmyaJet® 5020) in combination with a variety of latex binders and polyvinyl alcohol (Mowiol® 15-99). Such coating formulations are illustrated in TABLE 3 below. Numbers given are "dry parts basis" (part per weight). Coating compositions (e), (f) and (g) are obtained by mixing ingredients such as described in the TABLE 4. The numbers in this table are in part per weight. In coating compositions (e), (f) and (g), silica pigments are added in view of improving imaging performances. The coating mixes are prepared in a beaker at about 30 wt % solids with an overhead stirrer.

TABLE 3

| Class of ingredients | | Coating formulations (a) | (b) | (c) | (d) |
|---|---|---|---|---|---|
| pigments | Opacarb ® A40 | 80 | 80 | 80 | 80 |
| | OmyaJet ® 5020 | 20 | 20 | 20 | 20 |
| Latex and binders | Styronal ® D628 | 7 | — | — | — |
| | STR ® 5401 | — | 7 | — | — |
| | Gencryl ® PT9525 | — | — | 7 | |
| | Neocar ® latex 2300 | — | — | — | 7 |
| | Mowiol ®15-99 | 2 | 2 | 2 | 2 |
| Wetting and additives | Agitan ®103 | 0.35 | 0.35 | 0.35 | 0.35 |
| | Wax- Ultra lube E846 | 0.8 | 0.8 | 0.8 | 0.8 |
| | Carteren ®Violet 79732 | 0.005 | 0.005 | 0.005 | 0.005 |
| | Tinopal ® | 0.5 | 0.5 | 0.5 | 0.5 |
| | Solid % (final coating) | 44.5 | 44.5 | 44.5 | 44.5 |

TABLE 4

| Class of ingredients | | Coating formulations (e) | (f) | (g) |
|---|---|---|---|---|
| pigments | Opacarb ® A40 | 38 | 38 | 38 |
| | Ansilex ®93 | 12.5 | 12.5 | 12.5 |
| | Sylojet ®a25 | 15 | 15 | 15 |
| Latex and binders | Neocar ® latex 2300 | 18 | — | — |
| | Acronal ® s728 | — | 18 | — |
| | STR ®5401 | — | — | 18 |
| | Mowiol ®15-79 | 0.5 | 0.5 | 0.5 |
| Wetting and additives | Gasil ®IJ624 | 15 | 15 | 15 |
| | Rheovis ®802 | 1 | 1 | 1 |
| | Total Parts | 100 | 100 | 100 |

Coating compositions (a), (b), (c) and (d), as illustrated in TABLE 3, are applied on one side of a 90 gsm offset precoated base, as supporting substrate, to form image-receiving layer. Coating formulations (e), (f) and (g), as illustrated in TABLE 4, are applied onto on one side of a 31# uncoated base paper (from Appleton), as supporting substrate, to form image-receiving layer. The coating process is accomplished either in small quantities by hand drawdown using a Mayer rod in a plate coating station, or a lab scale "blade coater" in view of producing a media sheet having improved sheet quality and printing properties. The resulting coat weight is of about 7 g/m$^2$ per side. The media are then calendered using a lab calender at 1000 psi/room temperature/1 pass in view of obtaining inkjet recording materials A to F.

Example 3

Durability Performances of Inkjet Recording Material

Inkjet recording materials A, B, C and D, as obtained in Example 2 (i.e. respectively containing coating compositions (a), (b), (c) and (d)), are printed using an high-speed inkjet printer HP Edgeline Printer (CM8050) using pigmented ink composition used in the HP T300 webpresses. After printing, the durability of the prints is evaluated. The results are illustrated in TABLE 5 below. The durability of the samples is evaluated with a wet rub test. Such wet rub test is done using an auto pipette of 5 ml of deionized water that is dropped on a printed square. After 30 seconds, a Digital Ink Rub tester (TMI, inc.), using a 0.25 lb, weight is put onto the print and is rubbed for 5 rub cycle at 42 cycles per minute. The samples are then scanned into Photoshop and converted to a "gray-scale" image. A 228 pixel square is selected around each of the black print squares and the average pixel value (on a 0-255 scale) is recorded from the Histogram feature in Photoshop. In this test, a lower average pixel value is better (indicating that more black pixels are left in the image after the wet rub). The results demonstrate superior performances of the image-receiving layer composition containing Neocar® 2300. Such composition appears to be the least impacted by the wet rub durability test and provides therefore improved durability to the recording media that encompasses it.

TABLE 5

| Coated media | Coated formulation | Average Pixel Value (0-255) |
|---|---|---|
| A | (a) | 91 |
| B | (b) | 105 |
| C | (c) | 96 |
| D | (d) | 80 |

Example 4

Printing Performances of Inkjet Recording Material

Inkjet recording materials E, F and G, as obtained in Example 2 (i.e. respectively containing coating compositions (e), (f) and (g)), are printed on an HP CM8060 MFP with Edgeline technology (from Hewlett-Packard Corporation). Each of the recording material is air dried at room temperature for 24 hours after printing. The image quality of the recording materials E, F and G is then evaluated for the Color Gamut, KOD, Max. Bleed and Highlighter Smear performances. The results are illustrated in TABLE 6 below.

The Color Gamut measures the volume of color space enclosed inside the achievable colors. Color gamut is estimated from an eight-color model using Black, White, Red, Green, Blue, Cyan, Magenta and Yellow tiles. Spectro-densitometer Model 938, supplied by X-rite, is used as the instrument to measure it. A higher score means a better performance.

The KOD measures the black optical density of black areas fill. The KOD is measured by Spectro-densitometer Model 938 supplied by X-rite. A higher score means a better performance.

The Max Bleed is the highest distance that color bleeds from one color into another in adjacent tiles. A lower score means a better performance. The measurement is done on Personal Image Analysis System provided by Quality Engineering Associates (QEA). The result is reported as an average from 6 measurements.

The Highlighter Smear Test measures the smeared portion of the image outside of the originally printed sample image. It is expressed in milli optical density (milli OD). A higher value means more ink is smeared off and a lower value indicates improved smear fastness. The printed sheets are tested by using a Faber-Castell® highlighter pen at 24 72 hours after printing. Using an X-Rite densitometer, the optical density (OD) in the blank areas adjacent to the printed image is measured to determine the amount of ink being transferred from the printed image to the unprinted areas by the highlighter pens.

Results demonstrate that the coating composition containing Neocar® latex 2300 has the best performances. In particular, very low amounts of ink transfer are obtained in the highlighter test. Such composition is found to substantially reduce the amount of ink transferred, or "smeared," by a highlighter. It also improves color gamut, black optical density (Kod), and color-to-color bleed at the same time.

TABLE 6

| Coated MEDIA | (E) | (F) | (G) |
|---|---|---|---|
| Color Gamut | 200799 | 177251 | 187207 |
| KOD | 1.89 | 1.69 | 1.76 |
| abs Max Bleed | 13.2 | 59.0 | 18.8 |
| High-lighter Smear (mOD) 2 Passes, 72 hours, | 39 | 91 | 85 |

The invention claimed is:

1. An inkjet recording material, comprising a supporting substrate and an image-receiving layer formed on at least one side of the supporting substrate; said image-receiving layer comprising at least one inorganic pigment and a latex polymer binder having monomers of a general formula (I):

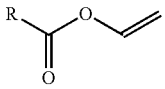

wherein R is a branched, cyclic or unbranched alkyl group containing from 1 to 20 carbon atoms, and wherein the latex polymer binder is a terpolymer containing a vinyl acetate monomer, a vinyl acrylate monomer, and a vinyl versatate monomer.

2. An inkjet recording material comprising a supporting substrate and an image-receiving layer formed on at least one side of the supporting substrate; said image-receiving layer comprising at least one inorganic pigment and a latex polymer binder having monomers of a general formula (I):

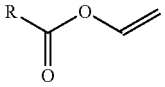

wherein R is a branched, cyclic or unbranched alkyl group containing from 1 to 20 carbon atoms; and wherein the latex polymer binder is a polyethylene-vinylversatate copolymer.

3. The inkjet recording material, according to claim 1, wherein the latex polymer binder is present in an amount representing from about 0.1 wt % to about 30 wt % by total weight of the image-receiving layer.

4. The inkjet recording material, according to claim 1, wherein the at least one inorganic pigment is selected from the group consisting of silica, boehmite, pseudoboehmite, calcium carbonate, precipitated calcium carbonate, ground calcium carbonate, modified calcium carbonate and kaolin clay.

5. The inkjet recording material, according to claim 1, wherein the at least one inorganic pigment includes a first inorganic pigment and a second inorganic pigment.

6. The inkjet recording material, according to claim 5, wherein the first inorganic pigment is precipitated calcium carbonate (PCC).

7. The inkjet recording material, according to claim 5, wherein the second inorganic pigment is ground calcium carbonate (GCC) or clay pigment.

8. The inkjet recording material, according to claim 1, wherein the at least one inorganic pigment contains at least three pigments and wherein a first pigment is precipitated calcium carbonate (PCC), a second pigment is ground calcium carbonate (GCC) or clays, and a third pigment is a silica pigment or a combination of different silica pigments.

9. The inkjet recording material, according to claim 1, wherein the supporting substrate is a paper base containing cellulose fibers.

10. The inkjet recording material, according to claim 1, wherein the image-receiving layer is formed on both sides of the supporting substrate.

11. A method of making an inkjet recording material, comprising:

a. providing a supporting substrate;

b. applying an image-receiving layer to, at least, one side of the supporting substrate, said image-receiving layer containing at least one inorganic pigment and a latex polymer binder having monomers of a general formula (I):

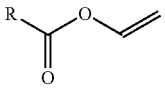

wherein R is a branched, cyclic or unbranched alkyl group containing from 1 to 20 carbon atoms, and wherein the latex polymer binder is a terpolymer containing a vinyl acetate monomer, a vinyl acrylate monomer, and a vinyl versatate monomer c. and drying and calendaring the image-receiving layer.

12. The method according to claim 11 wherein the image-receiving layer is applied onto the supporting substrate in view of having a coat weight that is in the range of about 0.5 to about 20 g/m$^2$.

13. A method for producing printed images, comprising:

a. obtaining an inkjet recording material containing a supporting substrate and an image-receiving layer formed on at least one side of the supporting substrate; said image-receiving layer comprising at least one inorganic pigment and a latex polymer binder having monomers of a general formula (I):

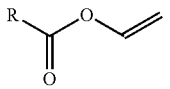

wherein R is a branched, cyclic or unbranched alkyl group containing from 1 to 20 carbon atoms, and wherein the latex polymer is a terpolymer containing a vinyl acetate monomer, a vinyl acrylate monomer, and a vinyl versatate monomer; and b. applying an ink composition onto said inkjet recording material, to form a printed image.

14. The method for producing printed images according to claim 13 wherein the ink composition is established on the recording material via inkjet printing technique.

15. The inkjet recording material according to claim 5 wherein the first inorganic pigment is precipitated calcium carbonate (PCC), and the second inorganic pigment is ground calcium carbonate (GCC).

16. The inkjet recording material according to claim 8 wherein the first pigment has a particle size less than 1 μm, the second pigment has a particle size ranging from about 0.5 μm to about 10 μm, and the third pigment has a surface area of either 50 $m^2$ per gram, 100 $m^2$ per gram or 200 $m^2$ per gram.

* * * * *